United States Patent [19]

Schwarze

[11] 4,262,509

[45] Apr. 21, 1981

[54] ARRANGEMENT FOR POSITIONING A WORKPIECE

[76] Inventor: Rigobert Schwarze, Olpener Strasse 460-474, 5000 Koeln 91, Fed. Rep. of Germany

[21] Appl. No.: 57,378

[22] Filed: Jul. 13, 1979

[30] Foreign Application Priority Data

Jul. 24, 1978 [DE] Fed. Rep. of Germany ..... 2832398

[51] Int. Cl.[3] ..... B21C 37/00

[52] U.S. Cl. ..... 72/10; 72/26; 72/31; 72/133; 228/9

[58] Field of Search ..... 73/638; 72/133, 26, 72/31, 369, 367, 368, 10; 29/407; 228/9

[56] References Cited

U.S. PATENT DOCUMENTS 3,360,177 12/1967 Enkvist ..... 228/9

FOREIGN PATENT DOCUMENTS 1963214 6/1971 Fed. Rep. of Germany ..... 228/9

47-17638 9/1971 Japan ..... 228/9

*Primary Examiner*—Ervin M. Combs

*Assistant Examiner*—C. J. Arbes

*Attorney, Agent, or Firm*—Michael J. Striker

[57] ABSTRACT

An arrangement for positioning a workpiece having a portion to be located in a predetermined orientation relative to a work station, includes a device for displacing a workpiece so that the above-mentioned portion thereof moves along a predetermined trajectory. A sensing device shuts down the displacing device when the above-mentioned portion of the workpiece is in a desired predetermined orientation relative to a work station.

26 Claims, 7 Drawing Figures

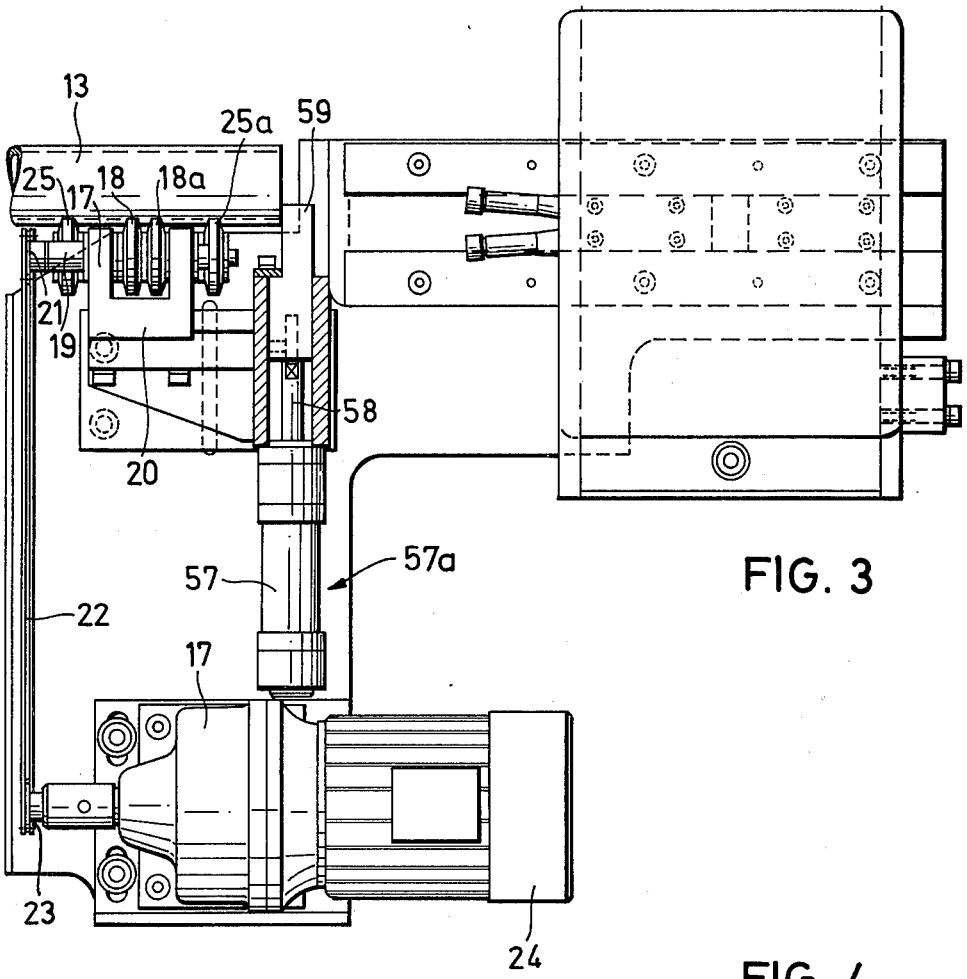
FIG. 3
FIG. 4
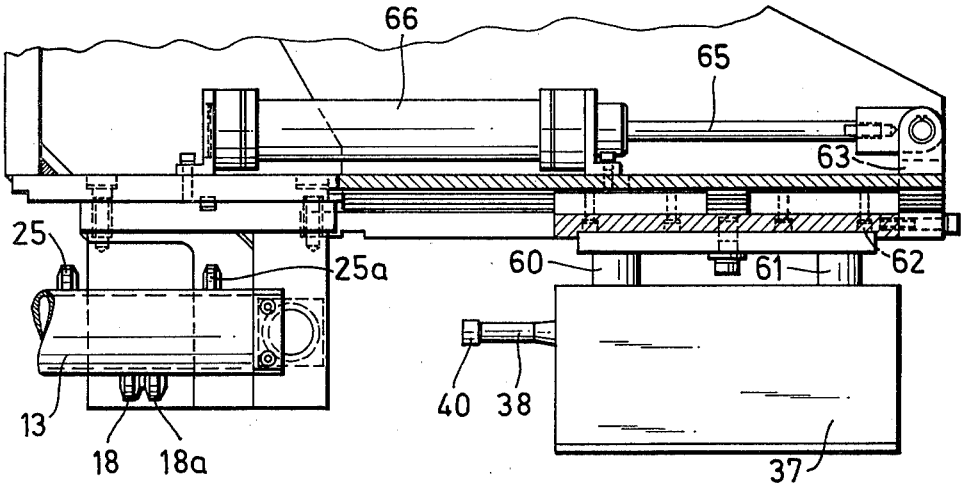

ARRANGEMENT FOR POSITIONING A WORKPIECE

BACKGROUND OF THE INVENTION

The present invention relates to bending machines.

More particularly, the present invention is concerned with arrangements for locating a workpiece, for example, a tube, having a welding seam, in a predetermined position (i.e. orientation) before this workpiece is actually bent on a bending machine.

It is known to manufacture tubes from rectangular sheet material strips which are rolled up to form a tube whose two longitudinal edges are then welded to each other. Since the welding seam is raised above the outer circumferential surface of the tube, it is the usual practice in many cases to grind the welding seam at the outer tube surface so that, the seam becomes even (i.e. flush) with the peripheral surface of the tube as considered in the circumferential direction of the latter.

When the tubes of this type are to be bent, the effectiveness and accuracy of the bending process are known to depend a great deal on the position of the longitudinal welding seam relative to the bending form (i.e. template). Namely, it is very important for the eventual results of the bending process whether the welding seam faces the bending form, when the tube to be bent is installed on the bending machine, or is located on an opposite side of the tube, i.e., the side which faces away from the bending form. Further, the welding seam may be located above a central, longitudinal axis of the tube or below this axis, when the tube is ready to be bent on the bending machine.

Obviously, depending on the actual position of the welding seam relative to the bending form of the bending machine one may differently bend the tube since the welding seam has physical properties different from those of the material of the tube to be bent. Since the welding seam as a rule provides the tube with a portion having a relatively enlarged thickness, it becomes necessary to apply different bending forces to the welding seam as opposed to that which is applied to the remaining portion of the tube. Moreover, the material of the welding seam has resilient properties different from those of the material of the respective tube.

Thus, in order to obtain uniform bending of the tube having a longitudinal welding seam, it is desirable to locate the tube to be bent in general and the longitudinal welding seam in particular in a predetermined position uniformly with respect to the bending form of the bending machine.

It is known to manually adjust the tube to be bent, relative to the bending form, after the tube has been installed on the bending machine but before the tube has been clamped. Thus, the tube is manually rotated on a support until the welding seam is in a predetermined position relative to the bending form. When the desired position of the tube has been achieved, the latter is clamped and ready to be bent.

Obviously, such a manual rotation of the tube to be bent is rather difficult considering, for example, the weight and the length of the tube which sometimes may be considerable. On the other hand, such a manipulation with the tube is rather time-consuming. Moreover, the manual manipulations with the tube make it impossible to fully automate the process of locating the tube on the bending machine relative to the bending form. The manual adjusting of the tube considerably increases the overall time of the bending process. It should be further understood that the manual handling of the tube constitutes substantial danger for an operator since the outer surface of the tube in general and the welding seam in particular may include a great number of very sharp portions which might cut the hands of the operator. However, the tube has to be precisely located (i.e. oriented) with its welding seam relative to the bending form, which requires an increased attention from the operator. Unfortunately, the welding seam, especially if the same has been ground, may not always be very easy to spot. On the whole, a great number of very likely mistakes are inherent to the manual adjusting of such tubes.

SUMMARY OF THE INVENTION

It is a general object of the present invention to avoid the dsiadvantages of the prior art arrangements for positioning a workpiece.

More particularly, it is an object of the present invention to provide an arrangement for positioning a workpiece, e.g. a tube having a longitudinal welding seam, in a fast and simple manner relative to a work station.

Another object of the present invention is to provide an arrangement for positioning a workpiece, which makes it possible to automate the process of installing workpieces relative to a work station.

Still another object of the present invention is to provide an arrangement which renders it possible to reliably position a workpiece having a portion to be located in a predetermined orientation relative to a work station.

In puruance of these objects and others which will become apparent hereafter, one feature of the present invention resides in providing an arrangement for positioning a workpiece having a portion to be located in a predetermined orientation relative to a work station. The arrangement comprises means for displacing a workpiece so that said portion thereof moves along a predetermined trajectory, and means for shutting down said displacing means when the workpiece is in a desired predetermined orientation relative to a work station.

In accordance with another feature of the present invention, the displacing means include means (e.g. a motor) for rotating the workpiece about an axis.

In accordance with still another feature of the present invention the shutting down means include a sensing device and a switch device operatively connected to the sensing device. The sensing device is operative to detect the above-mentioned portion of the workpiece during rotation of the latter. Thus, when the sensing device detects said portion of the workpiece, during rotation of the latter, the switch device becomes actuated and shuts down the motor.

The workpiece may be a tube having a longitudinal welding seam. The sensing device, when in contact with the welding seam, actuates the switch device and the latter shuts down the motor. Thus, the tube is located with the welding seam thereof in a desired predetermined orientation relative to the work station.

In the case of a plurality of similar tubes each having a welding seam, the tubes are located in above discussed manner one after another. In other words, each of the plurality of tubes will be so located that the respective welding seam thereof is located in the predetermined orientation relative to the work station.

In a preferred embodiment of the present invention the work station constitutes a bending form of a bending machine. Thus, the longitudinal welding seam of the tube to be bent is located in a desired predetermined orientation relative to the bending form of the bending machine.

In yet another feature of the present invention, the tube to be bent may be correspondingly located when the latter is off the bending machine and then be transported in such a position on the latter. However, it is also possible to install the tube on the bending machine and then rotate the tube until the sensing device detects that the longitudinal welding seam is in the desired orientation relative to the bending form.

A clamping sleeve may be provided for clamping the tube when the latter is in the desired position. As long as the clamping sleeve clamps the tube, the longitudinal welding seam is uniformly and reliably fixed relative to the bending form of the bending machine. Such an arrangement makes it possible to use the desired orientation of the welding seam of the tube as an initial (i.e. starting) position of the tube during the bending process which is conducted on the bending machine provided with a numerical control system. Thus, should the bending machine be provided with a program device, the tube to be bent preserves its uniform orientation of the welding seam relative to the bending form even if the tube is to be multiple bent. On the other hand, such an arrangement ensures that the multiple bending of the tube is conducted in a simple and effective manner.

If the tube having a longitudinal welding seam is located in the desired predetermined orientation off the bending machine; then it is advisable to provide means for transporting this tube in such an orientation onto the bending machine. Such transporting means are particularly advantageous, when there is a plurality of similar tubes to be bent in a similar manner. In this case, during the bending of one tube, another tube is oriented correspondingly off the bending machine and is transported on the latter when said one tube is removed from the bending machine.

In a further feature of the invention, the sensing device may be a photocell control device which is operative to detect the welding seam when the latter contacts the device. It is also possible to provide the sensing device such as an ultrasonic transmitter and receiver arrangement which detects the difference between the material of the welding seam and that of the actual tube to be bent.

It is further advantageous to provide a mechanical detecting element which is operatively connected to an electric switch (i.e. the switch device).

In still a further feature of the invention, the rotating means include a braking motor which is operative for rotating rollers which fixedly clamp the tube so that the latter is rotated with the rollers. The motor is immediately stopped once the sensing device actuates the switch, which is operatively connected to the motor, when the welding seam contacts the sensing device. It is true, that so far it has not been possible to accomplish actually the immediate stop of the motor in response to a given actuating signal. In other words, there is always a certain time gap between the actuating signal is developed and the motor is actually stopped. Obviously, the tube will be slightly turned from the position where the welding seam has been detected into a position, where the rotation of the tube is actually stopped. However, this slight angular displacement of the tube is not that bad since this displacement will be precisely repeated on all the tubes within the plurality of tubes to be bent. In other words, all the tubes will maintain exactly the same orientation relative to the bending form.

In yet a further feature of the invention, the sensing device further includes at least one lever having one end provided with a detecting element and another end operatively connected to a cylinder-piston unit which is operated hydraulically or pneumatically. The lever is further connected to a displacement pick-up device which in its turn is connected to the motor for operating the same.

In a preferred embodiment of the present invention, there are provided two double-armed levers which are operatively connected to each other. Each of said levers is provided with a detecting element. Advantageously, one of the detecting elements is adapted to control an inner surface of the tube, whereas another of the detecting elements is adapted to control an outer surface of the tube. The levers have respectively a long and a short arm. The short arm of the respective levers supports the respective detecting element. The long arm of the respective levers is connected at the end thereof to a piston rod and a cylinder, respectively, of said cylinder-piston unit. There are further provided means for pivoting the levers about respective axes. The displacement pick-up device is located between the pivoting axes of the levers and the cylinder-piston unit.

It is further advisable to arrange a base rubber spring between the levers so as to at least partially damp the vibrations of the levers during rotation of the tube.

In still another feature of the present invention, the sensing device is mounted on a slidable carriage which is movable axially towards and away from the tube. The sensing device is movable together with the carriage so as to alternately move the detecting elements towards and away from the tube.

In yet another feature of the present invention, means are provided, for mounting the tube for rotation about said rotation axis. The mounting means include the above-mentioned driven rollers, operatively connected to the motor, and non-driven rollers which are located above and parallel to the driven rollers. The non-driven rollers are movable towards and away from the driven rollers so as to define a gap therebetween. The tube is installed in this gap and clamped between and by said driven and non-driven rollers. Each roller may be provided with a rubber outer surface. There are further provided means for fixing the tube between the driven and non-driven rollers so as to ensure that the tube is rotated in response to rotation of the driven rollers. Said fixing means include another cylinder-piston unit for movement of said non-driven rollers towards and away from said driven rollers. Said other cylinder-piston unit may be hydraulically or pneumatically operated. The reliable clamping of the tube between the above-mentioned rollers occurs when the non-driven rollers move towards the driven rollers. The reverse movement of the non-driven rollers, i.e. away from the driven rollers so as to release the tube, may be facilitated by resilient means normally urging the piston rod and the non-driven rollers away from the driven rollers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a view from above of an arrangement for positioning the workpiece, in accordance with the present invention;

FIG. 4 is a view from above of the arrangement shown in FIG. 3;

DESCRIPTION OF THE PREFERRED EMBODIMENTS

Figure 1:
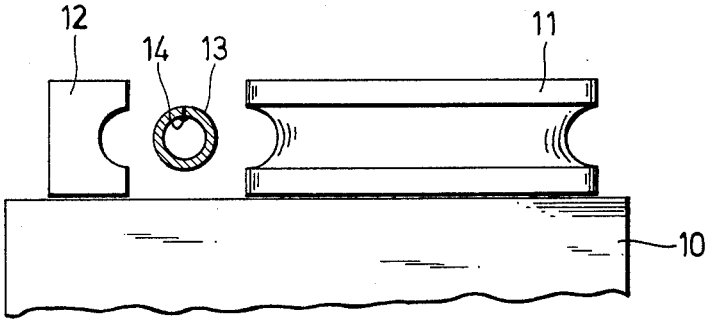
FIG. 1 is a view of a portion of a bending machine and a workpiece to be bent on this machine.

Referring now to the drawing and first to FIG. 1 thereof it may be seen that the reference numeral 10 is used to designate a bending table provided with a bending form 11 and a clamping jaw 12. A tube 13 to be bent constitutes a tubular sheet material strip whose longitudinal edges are connected to each other by a longitudinal welding seam 14.

One of the main objects of the present invention is to install the tube 13 so that the welding seam 14 is arranged uniformly, in a predetermined position relative to the bending form 11 and other parts of the bending machine.

Thus, for example, the tube 13 may be so installed on the bending machine that the welding seam 14 is located above a longitudinal central axis of the tube 13—see FIG. 1. Obviously, any other orientation of the tube 13 with the welding seam 14 is possible. If there is a number of the tubes 13 to be installed on the bending machine one after another, it may be desirable to have all the tubes 13 installed on the bending machine in one and the same predetermined orientation. For this purpose, it may be advisable to use the bending machines operated with numerical control data devices which may be adjusted to function in response to the actual orientation of the tube to be bent, in general and the welding seam of this tube in particular.

Figure 2:
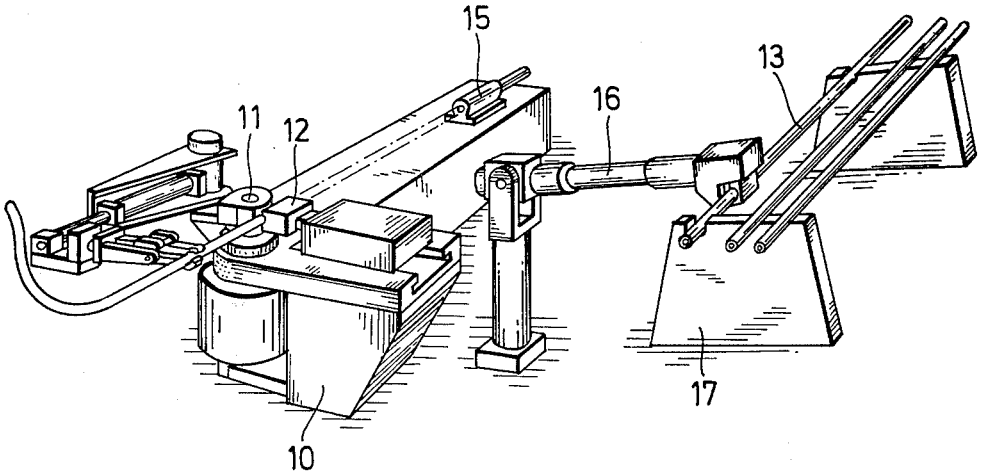
FIG. 2 is a perspective and substantially schematic view of the bending machine.

FIG. 2 illustrates the bending table 10 having the bending form 11, the clamping jaw 12 and a clamping sleeve 15 which is operative to transport the tube 13 to the bending form 11 and rotate the tube 13 during the bending process.

The reference numeral 16 is used to designate a delivery device which is operative to lift the tube 13 from a support 17 (i.e. table, etc.) and transport (i.e. deliver) the tube 13 onto the bending machine.

FIG. 3 illustrates the table 17 and a lower couple of rollers 18 and **18*a* which are connected by means of a shaft 19 which is mounted on a bearing block 20. A front end of the shaft 19 is provided with a chain wheel 21 which is operatively connected by means of a chain 22 to a chain wheel 23 which is mounted on an outgoing shaft of a braking motor 24**.

Figure 6:
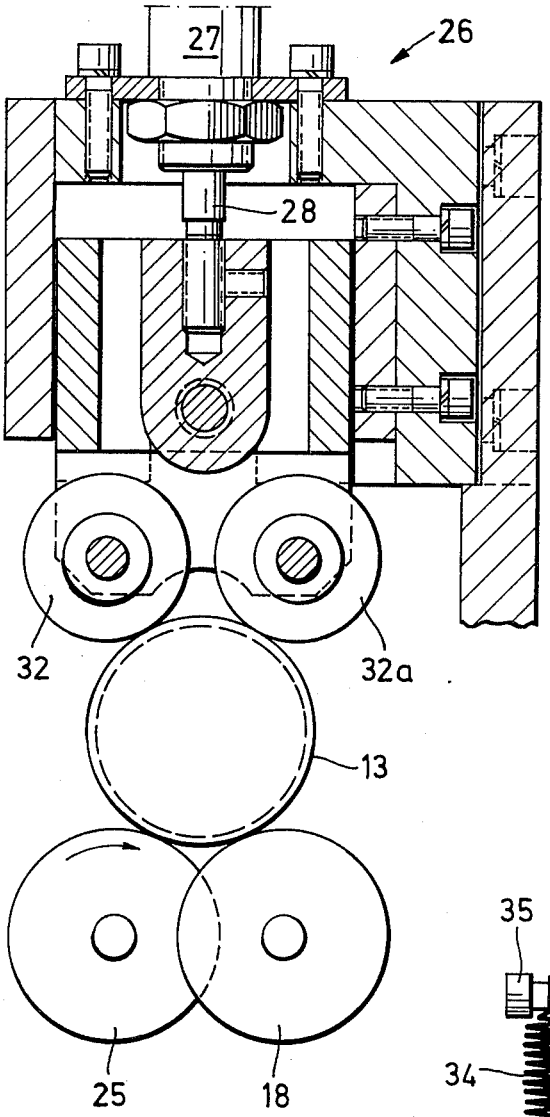
FIG. 6 is a view of a clamping device.

FIG. 4 shows the driven couple of rollers 18, **18*a* from above. FIG. 6 shows that the driven roller 18 is opposite to a non-driven roller 25. FIGS. 3 and 4 also show two opposite rollers 25 and 25*a*** which are spaced from one another.

Figure 7:
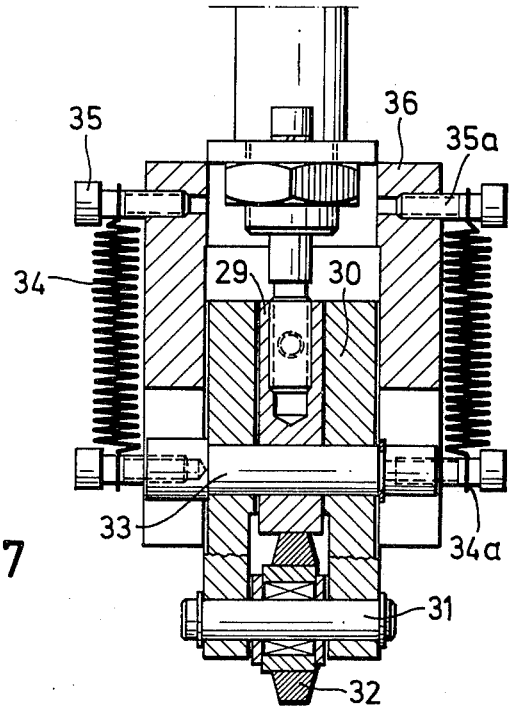
FIG. 7 is a view of an upper portion of the device shown in FIG. 6 and turned by 90°.

The tube 13 is located on the rollers 18, **18*a* and 25, 25*a*. A clamping device 26 is arranged above the tube 13. The clamping device includes at least one hydraulic or pneumatic cylinder-piston unit having a cylinder 27 and a piston 29 (see FIG. 6). The piston 28 is provided at a front end portion thereof with a cylinder boss 29 (i.e. eyelet) which has a guiding member 30 (see FIG. 7). The guiding member 30 has on its lower end a rubber roller 32 which is fixed on the member 30 by means of a bolt 31. FIG. 6 shows that the clamping device 26 may have two rubber rollers 32 and 32*a*, respectively. The guiding member 30 has another bolt 33 which supports via respective screws two spiral springs 34 and 34*a* on a housing 36. As soon as the tube 13 is installed on the rollers 18 and 25 from above thereof, the clamping device 28 is moved downwardly by means of the hydraulic or pneumatic cylinder-piston unit so that the rollers 32 and 32*a* engage the tube 13 from above thereof and press the same against the lower rollers 18 and 25**.

Figure 5:
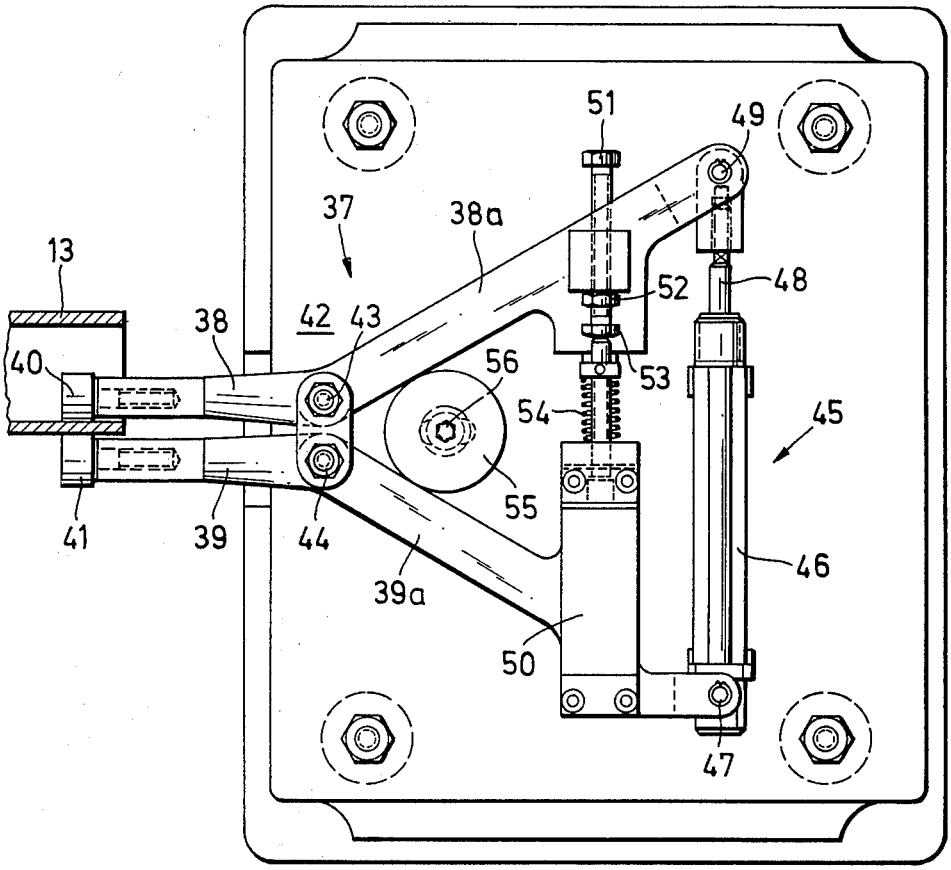
FIG. 5 is a view from above of a sensing arrangement shown in FIG. 3.

FIG. 5 is a side view showing an end portion of the tube 13 which engages a sensing device which is designated in toto by the reference numeral 37 and which is operative to detect the welding seam 14 of the tube 13.

The sensing device 37 includes two levers 38 and 39, each having two arms **38*a*, 38*b* and 39*a*, 39*b*, respectively. The relatively short arms 38*b* and 39*b* are provided on their front end portions with detecting rollers 40 and 41** respectively.

The levers 38 and 39 are pitovably mounted on a housing wall 42 by means of axes 43 and 44. The rear ends of the levers 38 and 39, namely the rear ends of the arms **38*a* and 39*a* are connected to a cylinder piston unit 45 which may be operated pneumatically or hydraulically. The cylinder-piston unit 45 has a cylinder 46 and a piston 48. The cylinder 46 is connected to the rear end of the arm 39*a* by means of a bolt 47. The piston 48 is connected to the rear end of the arm 38*a* by means of a bolt 49. In the area between the pivoting axes 43 and 44 on the one hand and the cylinder-piston unit 45 on the other hand, there is provided a displacement pick-up device 50. The displacement pick-up device 50 is known per se and therefore does not require any detailed description or illustration. In a preferred embodiment of the present invention the displacement pick-up device 50 may be a device known on the market under the name TWK-Electronic, Model 111. The pick-up device 50 is adjustable via an adjustment bolt 51 which is provided with two counter nuts 52 and 53 and a spiral spring 54**.

Between the pivoting axes 43 and 44 on the one hand and the displacement pick-up device 50 on the other hand, there is located a circular rubber spring member 55 which is arranged between and engaged with the arms **38*a* and 39*a* of the respective levers. The spring member 55 is mounted on the housing wall 42 by means of a bolt 56. The spring member 55 elastically presses the respective arms 38*a* and 39*a* outwardly and away from each other. At the same time, the spring member 55 serves for damping vibrations during the pivotal movement of the levers 38 and 39**.

FIG. 3 further shows a cylinder-piston unit **57*a* which is located above the braking motor 24 and includes a cylinder 57 and a piston 58 having an end stop 59. The end stop 59 is movable together with a piston 58 in a vertical plane and serves to axially position the tube 13. In order to orient the welding seam 14 of the tube 13, the latter is installed on the rollers 18 and 25. Then, the tube 13 is shifted axially until it abuts the end stop 59. After that, the clamping device 26 is actuated, i.e., it is moved downwardly. Simultaneously, the piston 58 with the end stop 29 moves back, that is downwardly away from the tube 13. Eventually, when the tube 13 is clamped, the same starts to rotate by means of the braking motor 24 via the driven rollers 18, 18***a* in the manner described hereabove in connection with the FIG. 3. During the rotation of the tube 13, the detecting rollers 40 and 41 are installed relative to the tube 13 in the position illustrated in FIG. 5. Before the detecting rollers 40 and 41 are moved in such a position, the piston rod 48 is moved in the cylinder 46 so that the arms 38*b* and 39*b* are moved apart from each other. Once the detecting roller 40 is introduced into the tube 13, the piston rod 48 is moved out of the cylinder 46 so that the levers 38 and 39 pivot about the respective axes 43 and 44 and on the spring member 55 to thereby move the arms 38*b* and 39*b* towards each other.

The longitudinal welding seam 14 of the tube 13 (during the rotation of the latter) comes into contact with the detecting roller 40 or 41. Since the welding seam 14 does not have an even (smooth) surface, the roughness of the same ensures that the arms 38*a* and 39*b* will be pressed outwardly away from each other. As a result the arms 38*a* and 39*a* will actuate the displacement pick-up device 50. The device 50 will immediately send an electrical signal onto the braking motor to shut down the same. Thus, the tube 13 in general and the welding seam 14 thereof in particular are arranged in a certain position (orientation) relative to the detecting rollers 40 and/or 41 or to the vertical plane extending transversely to the longitudinal axis of the tube 13. After the tube is stopped, the sensing device 37 is moved away from the tube 13. In other words, the detecting rollers 40 and 41 are removed away from the tube 13. After that, the tube 13 may be clamped by the arm 16 shown in FIG. 2 and delivered on the bending machine.

On the bending machine, the tube 13 is held by the clamping sleeve 15, which is conventionally mounted on a slit. The tube 13 is thusly positioned on the bending machine in the exact orientation the same tube was on the table 13 before being transported by the delivering arm 16 on the bending machine. Thus, the longitudinal welding seam of the tube 13 is arranged in a predetermined orientation relative to the parts of the bending machine in general and the bending form of the latter in particular. This position of the welding seam of the tube is preserved uniformly along the elongation of the tube after the latter has been bent.

As shown in FIG. 5, the detecting rollers 40 and 41, when spaced one from the other, are introduced into the tube 13 and then the rollers 40 and 41 are brought towards each other so as to touch the respective inner and outer surface of the tube 13. When the rollers 40 and 41 are brought in such a position relative to the tube 13, the latter is rotated by means of the motor 24. The rotation of the tube 13 is immediately stopped once the rollers 40 and 41 (or at least one of them) is deflected as a result of the unevenness (i.e. roughness) of the welding seam 14 once the latter engages with the detecting rollers. Once the rollers 40 and 41 detect the unevenness of the welding seam (in comparison with the remaining circumferential surface of the tube 13), the pick-up device 50 becomes actuated in the hereabove described manner and the motor 24 is stopped.

In another embodiment of the present invention, the sensing device 37 includes only one lever, e.g., the lever 38 with one detecting roller, e.g. the roller 40. Obviously, instead of using the lever 38 with the detecting roller 40 one can adequately use the lever 39 with the detecting roller 41. The choice between the levers 38 and 39 with respective detecting rollers 40 and 41 obviously depends whether the tube 13 has the welding seam on an inner or an outer surface.

The sensing device 37 having two levers 38 and 39 (see FIGS. 3 and 5) is especially advantageous since such a device can detect the unevenness of the welding seam located on the inner and/or outer surface of the tube 13. It is advisable to use both detecting rollers even in the case where the outer surface of the tube 13 is ground in order to eliminate the unevenness of the welding seam 14. In this case, the detecting roller 41, adapted to control the outer surface of the tube 13, facilitates the function of the detecting roller 40 to detect the unevenness of the welding seam on the inner surface of the tube 13. Moreover, the two-armed sensing device 27 ensures the precise and effective control of the motor 24, by means of the pick-up device 50, in response to detecting the unevenness of the welding seam in the tube 13.

It should be understood that the sensing device 37 may be installed directly on the bending machine.

FIG. 4 shows from above, the sensing device 37 having the lever 38 with the detecting roller 40 extending in direction towards the tube 13. The device further includes two bolts 60 and 61 and the round rubber spring for damping vibrations of the device 37. The device 37 is mounted on a sliding carriage 62 which is connected by means of a strap 63 to a piston rod 65 of a pneumatic or hydraulic cylinder-piston unit 66. In response to displacement of the piston rod 65 the sliding carriage 62 with the device 37 moves axially and alternately towards and from the tube 13 so that the detecting roller 40 becomes respectively inserted into or withdrawn from the tube 13.

It will be understood that each of the elements described above, or two or more together, may also find a useful application in other types of an arrangement for positioning a workpiece differing from the types described above.

While the invention has been illustrated and described as embodied in an arrangement for positioning a workpiece it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for positioning a workpiece having a portion to be placed in a predetermined orientation relative to a work station, comprising means for displacing a workpiece so that said portion thereof moves along a predetermined trajectory; means for rotating the workpiece about an axis of rotation; and shut-down means including a sensing device and a switch device, said sensing device having at least one lever with one end portion provided with a detecting element adapted to detect said portion of the workpiece during the displacement of the workpiece and another end portion operatively connected to said switch device, said switch device being operatively connected to said displacing means for shutting down the same when said portion of the workpiece is in a desired predetermined orientation relative to the work station.

2. An arrangement as defined in claim 1, further comprising means mounting the workpiece for displacement along said trajectory and including a plurality of rollers clamping the workpiece and having a first set of rollers and a second set of rollers, said first set of rollers being operatively connected to said displacing means so that the workpiece, when clamped on said rollers is displaced by said displacing means.

3. An arrangement as defined in claim 2, wherein said second set of rollers is adapted to move towards and away from said first set of rollers operatively connected to said displacing means so as to define a gap between said sets, the workpiece being installed into said gap.

4. An arrangement as defined in claim 3, further comprising first means for moving said second set of rollers towards said first set of rollers so as to clamp the workpiece when the same is inserted into said gap.

5. An arrangement as defined in claim 2, wherein the rollers in said first set are provided with an outer circumferential surface of synthetic plastic material.

6. An arrangement as defined in claim 4 wherein said first moving means include a cylinder-piston unit including a cylinder and a piston rod movable relative to said cylinder and operatively connected to said second set of rollers for displacing the latter towards said first set of rollers.

7. An arrangement as defined in claim 4, and further comprising second means for moving said second set of rollers away from said first set of rollers so as to release the workpiece when the latter is in said gap.

8. An arrangement as defined in claim 7, wherein said second means include resilient means normally urging said second set of rollers away from said first set of rollers with a biasing force so that said first means overcome said biasing force of said resilient means when said second set of rollers are moved towards said first set of rollers.

9. An arrangement as defined in claim 1, wherein said rotating means include a motor.

10. An arrangement as defined in claim 1, and further comprising means for moving said detecting element alternately towards into engagement with and away from the workpiece.

11. An arrangement as defined in claim 10, wherein said moving means include a cylinder-piston unit having a cylinder and a piston rod movable in and relative to said cylinder and operatively connected to said lever for pivoting the same about a pivoting axis so as to alternately move said detecting element towards and away from the workpiece.

12. An arrangement as defined in claim 11, wherein said cylinder-piston unit is pneumatically operated.

13. An arrangement as defined in claim 11, wherein said cylinder-piston unit is hydraulically operated.

14. An arrangement as defined in claim 1, wherein said sensing device includes two levers operatively connected to one another, each of said levers having one end portion provided with a detecting element adapted to detect said portion of the tube and another end portion operatively connected to said switch device.

15. An arrangement as defined in claim 14, wherein the workpiece has one surface and another surface, one of said detecting elements being adapted to engage said one surface of the workpiece, another of said detecting elements being adapted to engage said other surface of the workpiece.

16. An arrangement as defined in claim 14, and further comprising means for moving said detecting elements alternately towards into engagement with or away from the respective surfaces of the workpiece.

17. An arrangement as defined in claim 16, wherein said moving means include a cylinder-piston unit for pivoting said levers about respective pivotal axes so as to alternately move said detecting elements towards or away from the workpiece.

18. An arrangement as defined in claim 17, wherein said switch device is located between said cylinder-piston unit and said pivotal axes of said levers.

19. An arrangement as defined in claim 14, and further comprising means for damping vibrations of said levers when said detecting elements are engaged with the workpiece displaced along the predetermined trajectory.

20. An arrangement as defined in claim 19, wherein said damping means include at least one resilient element located between and engaged with said levers.

21. An arrangement as defined in claim 20, wherein said resilient element is a spring.

22. An arrangement as defined in claim 20, wherein said resilient element is of rubber.

23. An arrangement as defined in claim 1, and further comprising means for transporting said sensing device in direction towards and away from the workpiece.

24. An arrangement as defined in claim 23, wherein said transporting means include a sliding carriage supporting said sensing device for movement in said direction.

25. An arrangement as defined in claim 6, wherein said cylinder-piston unit is hydraulically operated.

26. An arrangement as defined in claim 6, wherein said cylinder-piston unit is pneumatically operated.

* * * * *